US006098805A

United States Patent [19]

Kent

[11] Patent Number: 6,098,805

[45] Date of Patent: Aug. 8, 2000

[54] DUAL BUCKET ASSEMBLY

[75] Inventor: David Kent, Lake Elsinore, Calif.

[73] Assignee: Kenmont, LLC, Mission Viejo, Calif.

[21] Appl. No.: 09/127,930

[22] Filed: Aug. 3, 1998

Related U.S. Application Data

[63] Continuation-in-part of application No. 09/095,693, Jun. 10, 1998.

[51] Int. Cl.[7] ..... B65D 1/24; B65D 1/42; B65D 8/08; B65D 21/00

[52] U.S. Cl. ..... 206/518; 220/23.8; 220/555; 220/640; 220/643; 220/764

[58] Field of Search ..... 220/23.4, 23.8, 220/23.83, 500, 553, 555, 556, 640, 641, 643, 762, 764; 206/505, 506, 515, 518, 516, 517

[56] References Cited

U.S. PATENT DOCUMENTS

| | | | |
|---|---|---|---|
| D. 139,569 | 11/1944 | O'Brien | 220/23.4 X |
| D. 212,831 | 11/1968 | Koch . | |
| D. 353,241 | 12/1994 | Breen . | |
| 992,480 | 5/1911 | Brown | 220/23.4 |
| 1,199,680 | 9/1916 | Fabian | 220/764 |
| 1,517,164 | 11/1924 | Lear . | |
| 1,644,063 | 10/1927 | Kircher | 220/764 |
| 1,997,362 | 4/1935 | Davis et al. . | |
| 2,314,835 | 3/1943 | Johns et al. | 220/23.4 |
| 2,321,981 | 6/1943 | Bowers . | |
| 2,470,432 | 5/1949 | Cusick . | |
| 2,712,668 | 7/1955 | Thiele . | |
| 2,785,826 | 3/1957 | Mappes . | |
| 2,896,809 | 7/1959 | Metzger et al. | 220/553 |
| 3,378,164 | 4/1968 | Witzgall | 220/643 |
| 3,389,828 | 6/1968 | Godshalk | 220/643 |
| 3,829,926 | 8/1974 | Salladay . | |
| 4,319,761 | 3/1982 | Wells . | |
| 5,199,571 | 4/1993 | Wolff et al. . | |
| 5,400,916 | 3/1995 | Weber . | |
| 5,641,087 | 6/1997 | Moffitt . | |
| 5,915,561 | 6/1999 | Lorenzana et al. | 220/556 X |

OTHER PUBLICATIONS

Rubbermaid Brute Buckets 1998 catalog, p. 42.

*Primary Examiner*—Allan N. Shoap
*Assistant Examiner*—Joe Merek
*Attorney, Agent, or Firm*—Calif Tervo

[57] ABSTRACT

A dual bucket assembly (10) comprises a dual bucket (20) including first and second containers (30, 50) adapted for holding liquid. Each container includes a peripheral wall (31, 51) having a proximal portion (34, 54) adjacent the other container and a non-proximal portion (37, 57). Connecting member (70) rigidly connects in a spaced apart relationship peripheral wall (31, 51) upper ends (32, 52). Peripheral walls (31, 51) are downwardly inwardly sloping such that a plurality of dual buckets (20) are nestable. Peripheral wall (31) proximal portion (34) is convex and peripheral wall (51) proximal portion (54) is concave and substantially parallel to proximal portion (34). Circumferential reinforcing member (94) connected to upper ends (32, 52) of non-proximal portions (37, 57) of peripheral walls (31, 51) resists bending and adds stiffness to the structure of dual bucket (20). A leveling device, bail detent mechanism (97), selectively secures proximal ends (81F, 81B) of bail (80) such that the position of bail distal end (82) is selectively maintained substantially above the center of gravity (12) of dual bucket assembly (10) when assembly (10) is freely hung from bail distal end (82).

26 Claims, 3 Drawing Sheets

FIG. 1
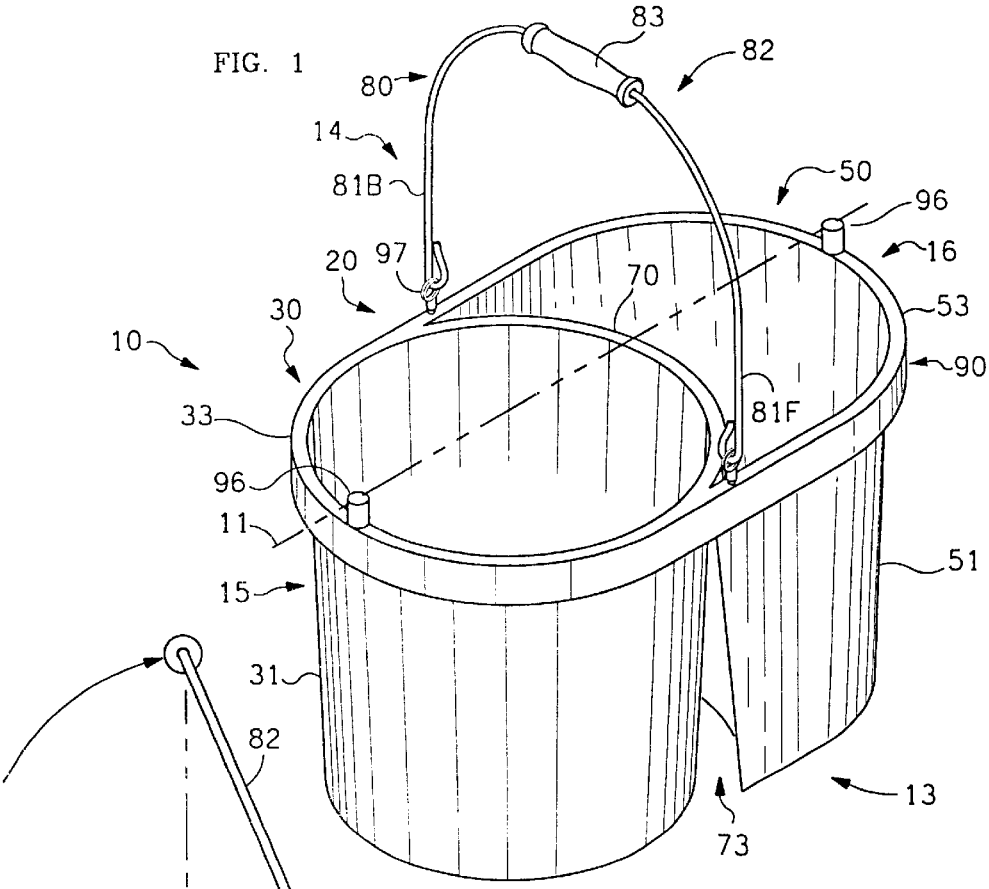
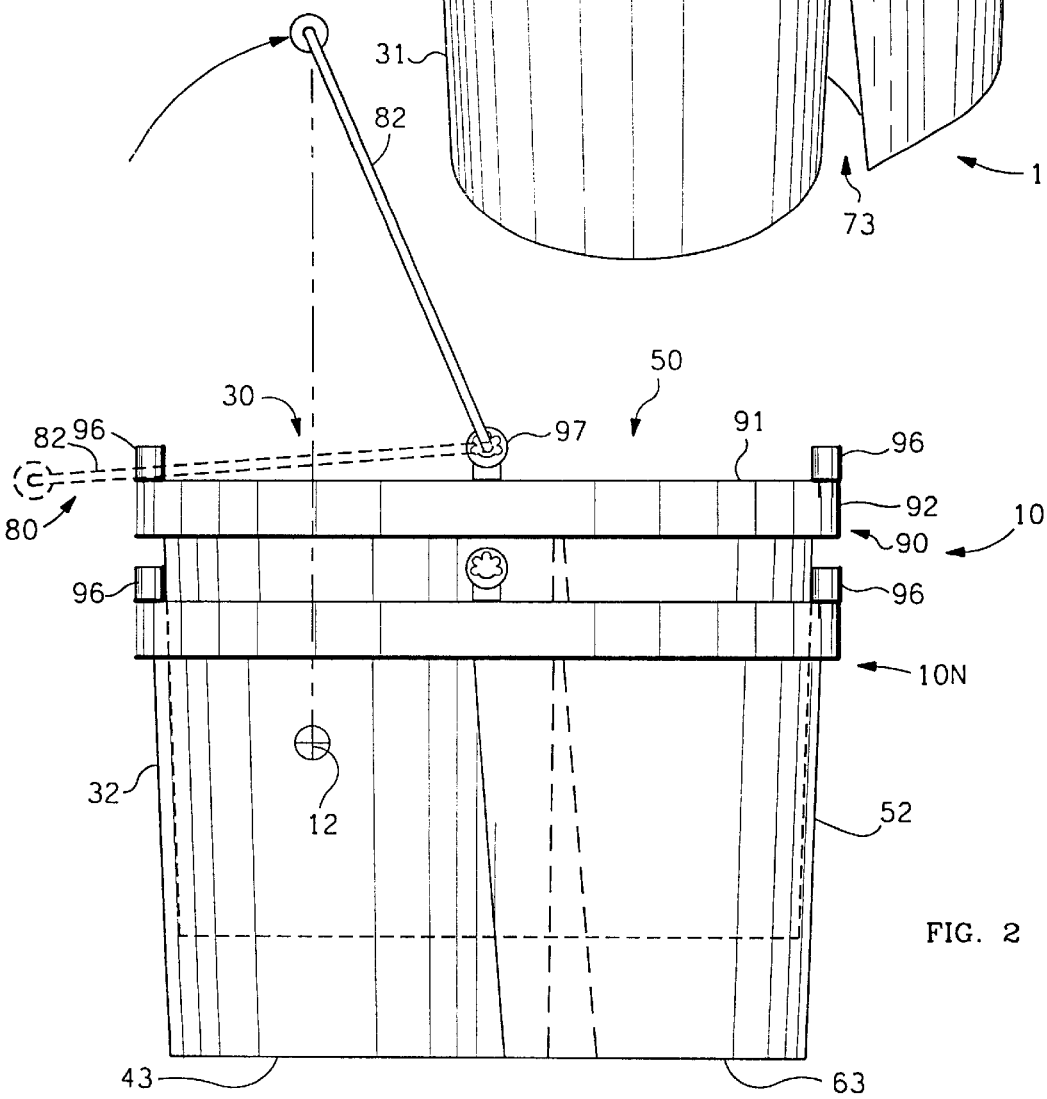
FIG. 2

FIG. 3
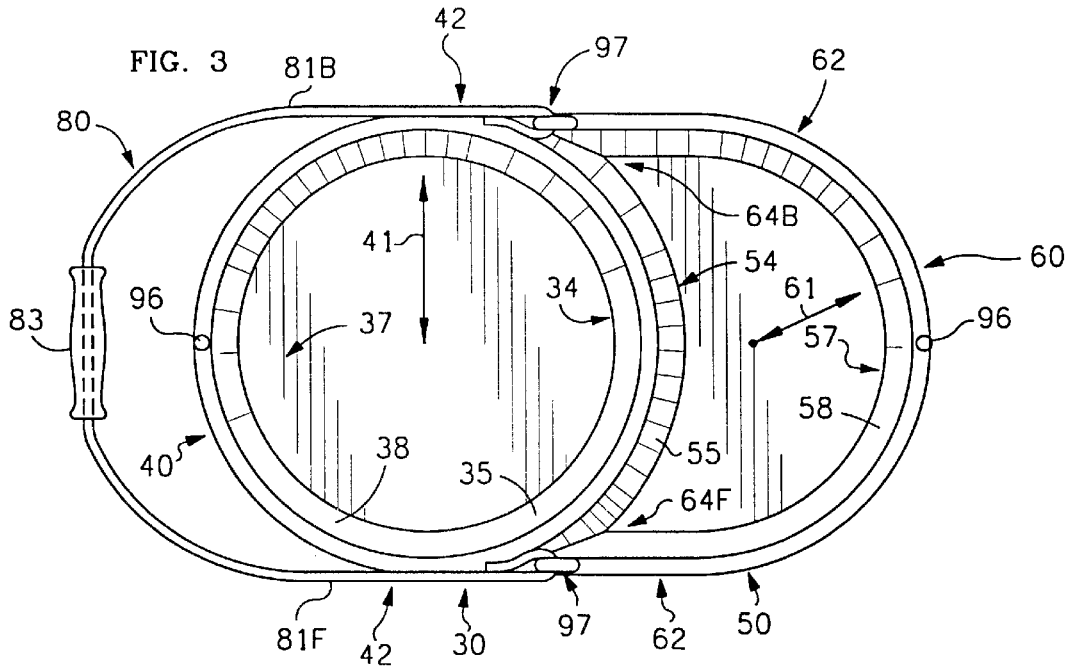
FIG. 4
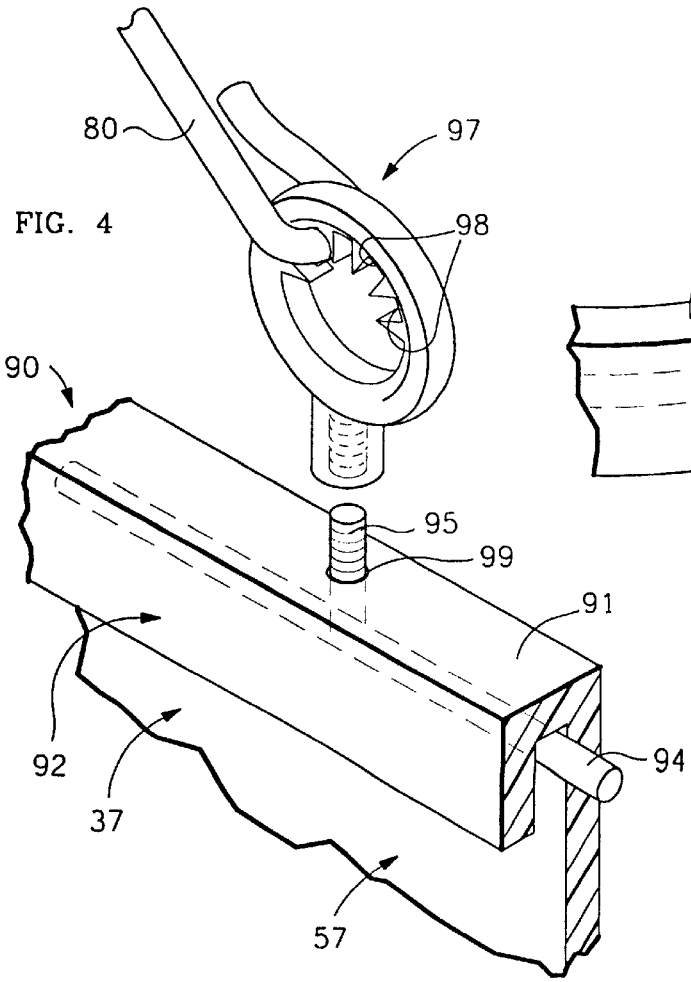
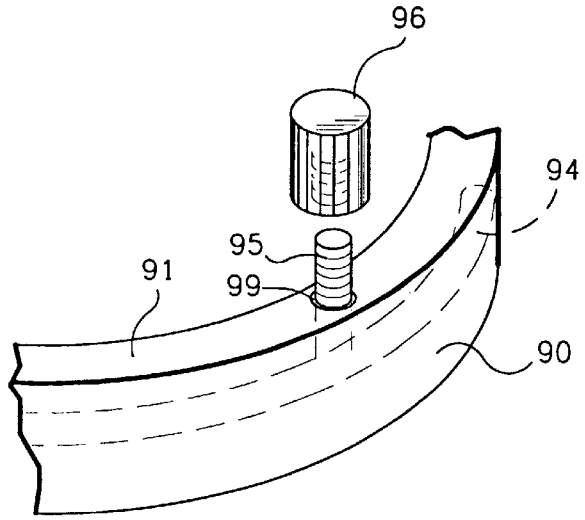
FIG. 5

FIG. 9
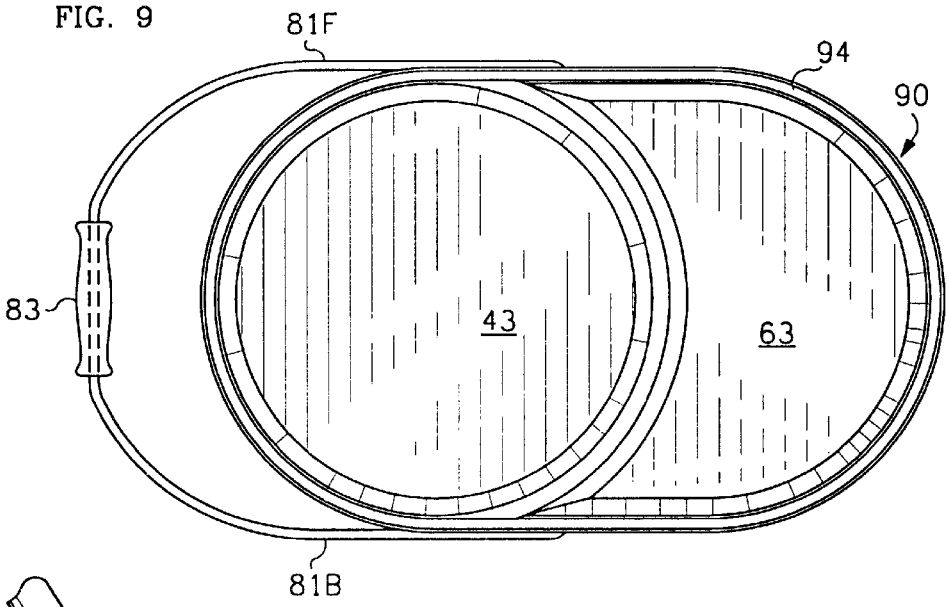
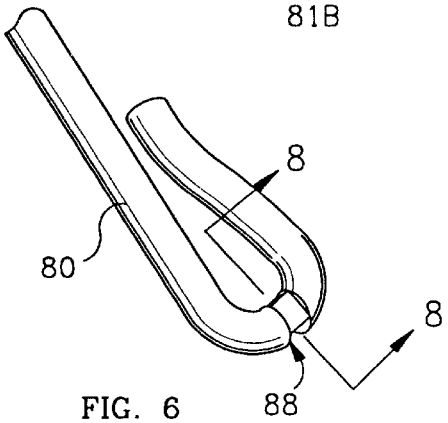
FIG. 6
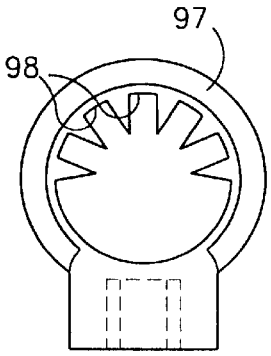
FIG. 7
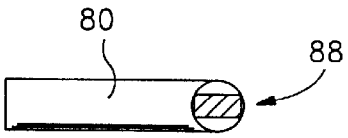
FIG. 8
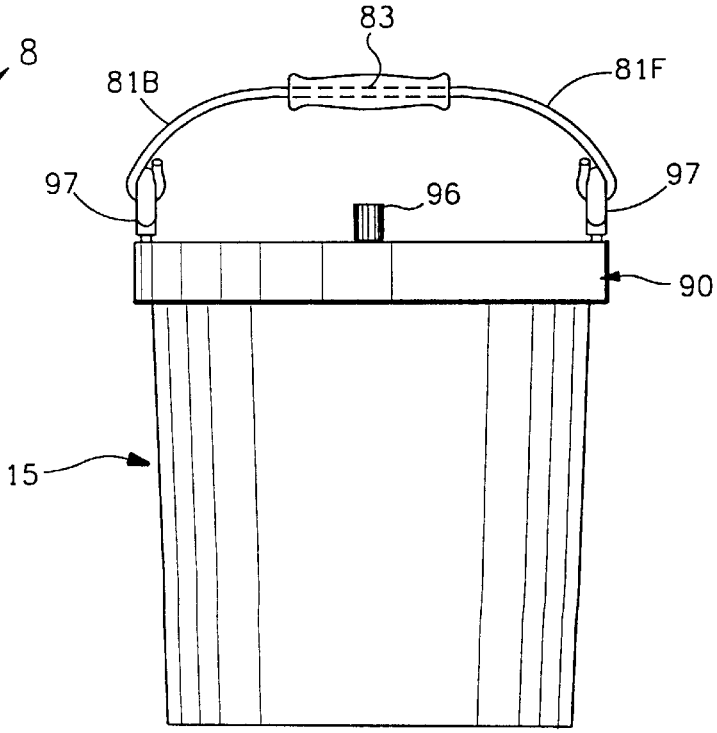
FIG. 10

DUAL BUCKET ASSEMBLY

CROSS REFERENCE TO RELATED APPLICATION

This is a continuation in part of a co-pending application Ser. No. 09/095,693, filed Jun. 10, 1998.

FIELD OF THE INVENTION

This invention relates to a dual bucket assembly, such as for working with stucco patch and water, and more specifically to a dual bucket assembly that is nestable and includes a leveling mechanism.

BACKGROUND OF THE INVENTION

It is often desirable to have two liquids available when performing certain tasks. For example, when working with stucco, it is a great time saver to have available simultaneously both stucco patch and water for cleaning tools. When painting, it is convenient to have access to two different paints. The paints may be of different colors and/or of different types, e.g. water based and oil based.

It is desirable to work from a level bucket. Often the center of gravity of a dual bucket is not centered such that the dual bucket cannot be carried or hung in a level position. Therefore, it is desirable to have means for leveling a dual bucket assembly.

For storage or shipping purposes, it is desirable that dual bucket assemblies are nestably stackable.

The various dual buckets that have been proposed in the prior art do not satisfy these needs.

SUMMARY OF THE INVENTION

This invention is a dual bucket assembly and it generally comprises a dual bucket including a first container particularly adapted for holding liquid that hardens upon drying and a second container adapted for holding liquid connected by a connecting member, and a bail.

In an exemplary embodiment, the first container includes a peripheral wall having an upper end having a top edge. The peripheral wall includes a proximal portion adjacent the second container. The second container includes similar elements.

A connecting member is attached to upper ends of peripheral walls and rigidly connects in a spaced apart relationship the upper ends of the peripheral walls of the containers.

The peripheral walls are downwardly inwardly sloping such that a plurality of the dual buckets are nestably stackable. The top edge of each non-proximal portion of the peripheral walls is smoothly arcuate.

The bail includes a distal end and proximal ends pivotally connected to either side of a longitudinal axis.

A leveling device, such as a bail detent mechanism, selectively secures the proximal ends of the bail such that the position of the distal end of the bail is selectively maintained substantially above the center of gravity of the dual bucket assembly when the assembly is freely hung from the distal end of the bail.

Other features and many attendant advantages of the invention will become more apparent upon a reading of the following detailed description together with the drawings in which like reference numerals refer to like parts throughout.

BRIEF DESCRIPTION OF THE DRAWINGS

FIG. 1 is a perspective view of a preferred embodiment of the dual bucket assembly of the invention.

FIG. 2 is a front elevational view and further shows an additional dual bucket assembly in a nested arrangement.

FIG. 3 is a top plan view of the dual bucket assembly of FIG. 1.

FIG. 4 is an enlarged cut-away perspective view of the leveling means and the reinforcing member attachment means of the dual bucket assembly of FIG. 1.

FIG. 5 is an enlarged cut-away perspective view of the reinforcing member attachment means of the invention.

FIG. 6 is an enlarged perspective view of a proximal end of a bail adapted for use with the leveling means of the invention.

FIG. 7 is an enlarged front elevational view of the leveling means of the dual bucket assembly of FIG. 1.

FIG. 8 is a cross-section of the bail proximal end taken on the line 8—8 in FIG. 6.

FIG. 9 is a bottom plan view of the dual bucket assembly of FIG. 1.

FIG. 10 is an end view of the dual bucket assembly of FIG. 1; the other end being a mirror image.

DETAILED DESCRIPTION OF THE INVENTION

With reference now to the drawings, FIG. 1 is a perspective view of a preferred embodiment of the dual bucket assembly 10 of the invention. The dual bucket assembly 10 generally comprises a dual bucket 20 including a first container 30 adapted for holding liquid, a second container 50 adapted for holding liquid, connecting means, such as connecting member 70, rigidly connecting containers 30, 50 in a spaced apart relationship, a bail 80, and leveling means, such as detent mechanism 97, for detaining bail 80 in a desired position. FIG. 1 also shows a circumferential reinforced drip rim 90 encircling dual bucket 20. Dual bucket 20 and its various components can be integrally constructed of flexible rubber, injection molded plastic, fiberglass, acrylic, or other similar material commonly used in pail construction and as is well-known in that art.

A longitudinal axis 11 runs through both containers 30, 50 such that a front side 13 of dual bucket 20 is located to one side of longitudinal axis 11 and a back side 14 of dual bucket 20 is located to the opposite side of longitudinal axis 11. Container ends, denoted generally as 15, 16, are preferably curved as shown in FIG. 1.

Looking also at FIG. 2, there is shown a front elevational view further showing an additional dual bucket assembly 10N in a nested arrangement. FIG. 3 is a top plan view of the dual bucket assembly of FIG. 1.

Referring now to FIGS. 1 through 3, various elements of first container 30 are shown including: a bottom 43; and a peripheral wall, denoted generally as 31, having an upper end 32 having a top edge 33; a proximal portion 34 of peripheral wall 31 adjacent second container 50; and a non-proximal portion 37 of peripheral wall 31 having side walls 42 and a curved end wall 40. The corresponding elements of second container 50 are also shown: a bottom 43 and a peripheral wall, denoted generally as 51, having an upper end 52 having a top edge 53; a proximal portion 54 of peripheral wall 51 adjacent first container 30; and a non-proximal portion 57 of peripheral wall 51 having side walls 62 and a curved end wall 60.

Dual bucket 20 is adapted for stacking a plurality of dual bucket assemblies 10 in a nested arrangement, as shown in FIG. 2. Peripheral walls 31, 51 are downwardly inwardly sloping making the lower portions of containers 30, 50 narrower than the upper portions near upper ends 32, 52. Connecting member 70 attached to upper ends 32, 52 of peripheral walls 31, 51 rigidly connects containers 30, 50 in a spaced apart relationship, as best seen in FIG. 1 where the space between proximal portions 34, 54 is denoted generally as 73. Space 73, as well as the downward, inward taper of containers 30, 50 facilitates storage of multiple dual buckets in a nested arrangement by allowing one dual bucket 20 to be nested within another dual bucket 20 to at least half, and preferably to 75% or more, of the depth of containers 30, 50. FIG. 2 shows dual bucket assembly 10 nested within dual bucket 10N substantially until connecting member 70 or bail detent mechanism 97 is encountered. Nesting is desirable because it minimizes the space required to store and transport a plurality of dual bucket assemblies 10.

Connecting member 70, connecting upper ends 32, 52 of containers 30, 50, spans the distance 73 between proximal portions 34, 54 and holds containers 30,50 in relative fixed position. Connecting member 70 may be integral with top edges 33, 53 of peripheral walls 31, 51, forming a rigid connecting structure. Connecting member 70 may be integral with reinforced drip rim 90 and support bail attachment means, such as bail attachment mechanism 97.

FIG. 4 is an enlarged cut-away perspective view of the leveling means, such as the preferred embodiment of bail detent mechanism 97, and includes means for attachment of the reinforcing member 94. FIG. 5 is an enlarged cut-away perspective view of a reinforcing member 94 attachment means.

Circumferential reinforcing member 94 connected to upper ends 32, 52 of non-proximal portions 37, 57 of peripheral walls 31, 51 adds stiffness and may be made of narrow gauge rigid metal wire, fiberglass, plastic or other material resistant to bending. Increased resistance to sagging is achieved if reinforcing member 94 is rigidly attached to drip rim 90. Circumferential reinforcing member 94 is positioned below horizontal member 91 of circumferential reinforced drip rim 90 and is disposed between non-proximal portions 37, 57 of peripheral walls 31, 51 and vertical member 92 of circumferential reinforced drip rim 90. Means for attaching reinforcing member 94 to drip rim 90 are illustrated in FIGS. 4 and 5, where horizontal member 91 of drip rim 90 contains orifices 99 therethrough for accommodating vertical studs 95 integral with reinforcing member 94. Bail detent mechanisms 97 and attachment knobs 96 may be threaded to receive vertical studs 95 thereby rigidly connecting reinforcing member 94 to drip rim 90, while still allowing a user of dual bucket assembly 10 selectively to remove reinforcing member 94 if desired. In an alternative embodiment, not shown, bail detent mechanisms 97 and attachment knobs 96 may themselves include integral studs extending downward through orifices 99 in horizontal member 91 of drip rim 90, and reinforcing member 94 may be adapted for receiving such projections.

Looking more closely at FIG. 3, the preferred embodiments of proximal portions 34, 54 and non-proximal portions 37, 57 of peripheral walls 31, 51 are shown. With respect to peripheral wall 31 of first container 30, the inside face 38 of non-proximal portion 37 is indicated, as is the inside face 35 of proximal portion 34. The corresponding inside face 58 of non-proximal portion 57 as well as the inside face 55 of proximal portion 54 are indicated with respect to peripheral wall 51 of second container 50.

A radius of curvature, denoted generally as 41, 61, of greater than two (2) inches provides a broad wiping surface such that the bristles of a large paint brush or other tool remain in contact with inside faces 38, 58 of top edges 33, 53 irrespective of the wiping location along non-proximal portions 37, 57. By eliminating corners with small radii of curvature which can trap liquid contents, smoothly arcuate non-proximal portions 37, 57 thus help painters achieve even distribution of paint on brushes and also facilitate cleaning of containers 30, 50.

Inside faces 35, 55 of proximal portions 34, 54 and inside faces 38, 58 of non-proximal portions 37, 57 are all preferably smooth so as not to create spaces where dried liquid can be trapped. Consequently, first container 30 is suitable for use with thick, pasty material such as stucco, plaster, cement, or other masonry compounds that harden when dry. In a preferred embodiment, dual bucket 20 is constructed of flexible material, such as rubber, such that containers 30, 50 are deformable. In this preferred embodiment, first container 30 may be distorted from its original shape, thereby breaking any dried contents away from peripheral wall 31 for removal and facilitating clean up.

To facilitate stability of dual bucket assembly 10 when freely hung by bail 80 from a ladder, circumferential drip rim 90 is preferably substantially planar in the vicinity of side walls 42, 62, making front side 13 and back side 14 of dual bucket 20 substantially planar and parallel to longitudinal axis 11 for approximately the middle third of the over-all distance between ends 15, 16. Either of the resulting substantially planar surfaces on front side 13 or on back side 14 will rest flush against the side member of a ladder, minimizing twisting of dual bucket assembly 10.

Non-proximal portions 37, 57 of peripheral walls 31, 51 are composed of curved end walls 40, 60 and side walls 42, 62 which are integral with reinforced drip rim 90 such that the over-all plan shape of dual bucket 20 is substantially oval as shown in FIG. 3. Curved end walls 40, 60 are preferably smoothly arcuate at top edges 33, 53 such that a user of dual bucket assembly 10 may wipe tools at any point along top edges 33, 53. FIG. 3 shows a top plan view of this preferred, substantially oval embodiment, where reinforced drip rim 90 follows curved end walls 40, 60 describing uniformly arcuate curves for wiping tools or the like, and further creates substantially planar front 13 and back 14 sides against which dual bucket assembly 10 hangs flat when suspended by the bail 80.

FIG. 3 further shows bail 80 in the horizontal, stored position. Bail 80 has a distal end 82 and proximal ends 81F, 81B pivotally connected to dual bucket 20 at bail attachment mechanism 97. In the preferred embodiment, bail 80 is attached at front side 13 and back side 14 of dual bucket 20 and is of sufficient length that it extends past peripheral walls 31, 51 such that it can be stowed in the horizontal position when a plurality of dual bucket assemblies 10 are stored in the nested arrangement. Bail 80 may be made of narrow gauge rigid metal wire, fiberglass, plastic or other material such as is common in ordinary water pails. Bail 80 may also be supplied with a carrying handle 83.

In use, dual bucket assembly 10 may be hung from distal end 82 of bail 80. If the contents of containers 30, 50 are not of equal weights such that the center of gravity 12 is not centered longitudinally, dual bucket 20 will hang at an awkward angle unsuitable for use. To correct an imbalance, distal end 82 of bail 80 can be secured substantially above center of gravity 12 of dual bucket assembly 10, as shown in FIG. 2. This location of distal end 82 ensures that dual bucket assembly 10 as a whole will remain substantially level when suspended by bail 80. Leveling means, such as bail detent mechanism 97, attached to dual bucket 20 allows the user of dual bucket assembly 10 selectively to secure proximal ends 81F, 81B of bail 80 such that the position of distal end 82 of bail 80 is maintained substantially above center of gravity 12 when the assembly 10 is freely hung from bail 80.

FIG. 4 is an enlarged cut-away perspective view showing a preferred embodiment of leveling means, such as bail attachment mechanism 97, of the invention in use. Referring also to FIGS. 6 through 8: FIG. 6 is an enlarged perspective view of a proximal end of a bail adapted for use with bail detent mechanism 97; FIG. 7 is an enlarged front elevational view of bail detent mechanism 97; FIG. 8 is a cross-section of the bail proximal end taken on the line 8—8 in FIG. 6.

In the preferred embodiment of bail attachment mechanism 97, the bail attachment location is fixed longitudinally but bail proximal ends 81F, 81B are selectively moveable between a freely pivoting position and a detent position wherein bail detent mechanism 97 detains proximal ends 81F, 81B of bail 80 such that the angle of bail 80 relative to vertical is selectively lockable. This detention may be accomplished by selectively engaging bail proximal ends 81F, 81B into one of a plurality of detention slots 98 oriented at varying angles from vertical and adapted for receiving and detaining the proximal ends 81F, 81B of the bail 80. As shown in FIGS. 6 and 8, proximal ends 81F, 81B include a portion, such as substantially rectangular cross-sectioned portion 88, for engaging with detention slot 98 and thereby preventing pivoting of bail 80.

Other embodiments of the leveling means are contemplated. For example, another embodiment of leveling means, not shown, comprises a sliding attachment for bail 80, wherein the entire leveling means slides longitudinally along the front side 13 and back side 14 of dual bucket 20. In such an embodiment, the attachment point of bail 80 can be shifted longitudinally such that a vertical line can be described through bail distal end 82, bail proximal ends 81F, 81B and center of gravity 12 of dual bucket assembly 10.

FIG. 9 is a bottom plan view of the dual bucket assembly of FIG. 1. FIG. 10 is an end view of the dual bucket assembly of FIG. 1; the other end being a mirror image.

Having described the invention, it can be seen that it provides a very convenient device for masonry and other work. The assembly can simultaneously accommodate a large combination of tools. Two different types of liquid or paste, such as wet stucco and water, are easily accessible at one time. The dual bucket hangs substantially level even when the center of gravity is off center. Although a particular embodiment of the invention has been illustrated and described, various changes may be made in the form, composition, construction, and arrangement of the parts without sacrificing any of its advantages. Therefore, it is to be understood that all matter herein is to be interpreted as illustrative and not in any limiting sense, and it is intended to cover in the appended claims such modifications as come within the true spirit and scope of the invention.

What is claimed is:

1. A dual bucket assembly comprising:

a dual bucket comprising:

a first container adapted for holding liquid; said first container including:

a bottom: and a peripheral wall connected to said bottom of said first container and having an upper end having a top edge; said peripheral wall of said first container including:

a proximal portion having:

a concave inner face; and a convex outer face; and a non-proximal portion having:

a concave inner face; and a convex outer face;

a second container adapted for holding liquid; said containers having substantially the same depth; said second container including:

a bottom; and a peripheral wall connected to said bottom of said second container and having an upper end having a top edge; said peripheral wall of said second container including:

a proximal portion proximal said proximal portion of said first container; said proximal portion of said second container having:

a convex inner face; and a concave outer face directly facing said convex outer face of said proximal portion of said peripheral wall of said first container; and a non-proximal portion having:

an inner face; and an outer face;

said peripheral walls of said first and second containers being downwardly inwardly sloping such that a plurality of said dual bucket assemblies are adapted for stacking in a nested arrangement; and connecting means connecting said upper end of said peripheral wall of said first container and said upper end of said peripheral wall of said second container.

2. The dual bucket assembly of claim 1 wherein:

said inner face of said peripheral wall of said first container is substantially continuously smoothly arcuate.

3. The dual bucket assembly of claim 1 wherein:

said inner face of said peripheral wall of said first container has a radius of curvature greater than two (2) inches.

4. The dual bucket assembly of claim 1 wherein:

said inner face of said peripheral wall of said first container is circular.

5. A dual bucket assembly comprising:

a dual bucket comprising:

a first container adapted for holding liquid; said first container including:

a bottom; and a peripheral wall connected to said bottom of said first container and having an upper end having a top edge; said peripheral wall of said first container including:

a proximal portion having:

a concave inner face; and a convex outer face; and a non-proximal portion having:

a concave inner face; and a convex outer face;

a second container adapted for holding liquid; said containers having substantially the same depth; said second container including:

a bottom; and a peripheral wall connected to said bottom of said second container and having an upper end having a top edge; said peripheral wall of said second container including:

a proximal portion proximal said proximal portion of said first container; said proximal portion of said second container having:

a convex inner face; and a concave outer face directly facing said convex outer face of said proximal portion of said peripheral wall of said first container; and a non-proximal portion having:
an inner face; and
an outer face;

said peripheral walls of said first and second containers being downwardly inwardly sloping such that a plurality of said dual bucket assemblies are adapted for stacking in a nested arrangement;

connecting means connecting said upper end of said peripheral wall of said first container and said upper end of said peripheral wall of said second container such that said dual bucket has a longitudinal axis through both said containers defining a front side to one side of the longitudinal axis and a back side to the opposite side of the longitudinal axis;

a single bail including:
a distal end; and
proximal ends including:
a front proximal end connected to said front side of said dual bucket; and
a back proximal end connected to said back side of said dual bucket; said bail of sufficient length that it extends past peripheral walls such that it can be stowed in the horizontal position when a plurality of dual bucket assemblies 10 are stacked in nested arrangement; and leveling means attached to said dual bucket for selectively securing a proximal end of said bail such that the position of said distal end of said bail is selectively maintained substantially above the center of gravity of said dual bucket assembly when said assembly is freely hung from said distal end of said bail.

6. The dual bucket assembly of claim 5 wherein said leveling means comprises:

detention means for detaining said proximal end of said bail such that the angle of said bail relative to vertical is selectively lockable in a plurality of positions.

7. The dual bucket assembly of claim 6 wherein said detention means includes:

a plurality of bail detention slots oriented at varying angles from vertical adapted for selectively receiving and detaining said bail at said proximal ends.

8. The dual bucket assembly of claim 5 wherein said first container is constructed of flexible material sufficiently deformable to shed therefrom wet masonry that has dried therein.

9. The dual bucket assembly of claim 5, further comprising:

a circumferential reinforcing member attached to said upper ends of said non-proximal portions of said peripheral walls.

10. The dual bucket assembly of claim 5, further comprising:

a circumferential drip rim including:
a horizontal member integral with said top edges of said peripheral walls; and
a vertical member opposite said outer faces of said upper ends of said peripheral walls; and a circumferential reinforcing member disposed between said outer faces of said peripheral walls and said vertical member of said drip rim.

11. The dual bucket assembly of claim 10, wherein said horizontal member of said drip rim contains a plurality of orifices therethrough;

and further including attachment means for rigidly attaching said circumferential reinforcing member to said dual bucket.

12. A dual bucket assembly comprising:

a dual bucket comprising:
a first container adapted for holding wet masonry; said first container including:
a bottom: and
a peripheral wall connected to said bottom of said first container and having an upper end having a top edge; said peripheral wall of said first container including:
a proximal portion having:
a concave inner face; and
a convex outer face; and
a non-proximal portion having:
a concave inner face; and
a convex outer face; said first container constructed of flexible material sufficiently deformable to shed therefrom wet masonry that has dried therein;

a second container adapted for holding liquid; said containers having substantially the same depth; said second container including:
a bottom; and
a peripheral wall connected to said bottom of said second container and having an upper end having a top edge; said peripheral wall of said second container including:
a proximal portion proximal said proximal portion of said first container; said proximal portion of said second container having:
a convex inner face; and
a concave outer face directly facing said convex outer face of said proximal portion of said peripheral wall of said first container; and
a non-proximal portion having:
an inner face; and
an outer face;

said peripheral walls of said first and second containers being downwardly inwardly sloping such that a plurality of said dual bucket assemblies are adapted for stacking in a nested arrangement; and connecting means connecting said upper end of said peripheral wall of said first container and said upper end of said peripheral wall of said second container.

13. The dual bucket assembly of claim 12, further comprising:

a circumferential reinforcing member attached to said upper ends of said non-proximal portions of said peripheral walls.

14. The dual bucket assembly of claim 12, further comprising:

a circumferential drip rim including:
a horizontal member integral with said top edges of said peripheral walls; and
a vertical member opposite said outer faces of said upper ends of said peripheral walls; and a circumferential reinforcing member disposed between said outer faces of said peripheral walls and said vertical member of said drip rim.

15. The dual bucket assembly of claim 14, wherein said horizontal member of said drip rim contains a plurality of orifices therethrough;

and further including attachment means for rigidly attaching said circumferential reinforcing member to said dual bucket.

16. The dual bucket assembly of claim 1 wherein:

one said dual bucket may be placed within another to at least ½ the depth of said containers.

17. The dual bucket assembly of claim 1 wherein:

said dual bucket has a longitudinal axis through both said containers defining a front side to one side of the longitudinal axis and a back side to the opposite side of the longitudinal axis; and said dual bucket assembly further includes:

a single bail including:

a distal end; and proximal ends including:

a front proximal end connected to said front side of said dual bucket; and a back proximal end connected to said back side of said dual bucket; said bail of sufficient length that it extends past peripheral walls such that it can be stowed in the horizontal position when a plurality of dual bucket assemblies 10 are stacked in nested arrangement.

18. The dual bucket assembly of claim 5 wherein said leveling means comprises:

a plurality of bail detention slots oriented at varying angles from vertical adapted for selectively receiving and detaining said bail upon upward movement of a said proximal end of said bail into a said slot.

19. The dual bucket assembly of claim 12 further including:

a bail including:

a distal end; and proximal ends including:

a front proximal end connected to said front side of said dual bucket; and a back proximal end connected to said back side of said dual bucket; and leveling means attached to said dual bucket for selectively securing a proximal end of said bail such that the position of said distal end of said bail is selectively maintained substantially above the center of gravity of said dual bucket assembly when said assembly is freely hung from said distal end of said bail; said leveling means comprising:

detention means for detaining said proximal end of said bail such that the angle of said bail relative to vertical is selectively lockable in a plurality of positions.

20. The dual bucket assembly of claim 12 further including:

a bail including:

a distal end; and proximal ends including:

a front proximal end connected to said front side of said dual bucket; and a back proximal end connected to said back side of said dual bucket; and leveling means attached to said dual bucket for selectively securing a proximal end of said bail such that the position of said distal end of said bail is selectively maintained substantially above the center of gravity of said dual bucket assembly when said assembly is freely hung from said distal end of said bail; said leveling means comprising:

a plurality of bail detention slots oriented at varying angles from vertical adapted for selectively receiving and detaining said bail upon upward movement of proximal end of said bail into a said slot.

21. A dual bucket assembly comprising:

a dual bucket comprising:

a first container adapted for holding liquid; said first container including:

a bottom: and a peripheral wall connected to said bottom of said first container and having an upper end having a top edge; said peripheral wall of said first container including:

a proximal portion having:

a concave inner face; and a convex outer face; and a non-proximal portion having:

a concave inner face; and a convex outer face;

a second container adapted for holding liquid; said second container including:

a bottom; and a peripheral wall connected to said bottom of said second container and having an upper end having a top edge; said peripheral wall of said second container including:

a proximal portion proximal said proximal portion of said first container; said proximal portion of said second container having:

a convex inner face; and a concave outer face directly facing said convex outer face of said proximal portion of said peripheral wall of said first container; and a non-proximal portion having:

an inner face; and an outer face;

said peripheral walls of said first and second containers being downwardly inwardly sloping such that a plurality of said dual bucket assemblies are adapted for stacking in a nested arrangement; said non-proximal portions of said peripheral walls forming a generally elliptical perimeter; and connecting means connecting said upper end of said peripheral wall of said first container and said upper end of said peripheral wall of said second container.

22. The dual bucket assembly of claim 21 wherein:

said containers have substantially the same depth.

23. A dual bucket assembly comprising:

a dual bucket comprising:

a first container adapted for holding liquid; said first container including:

a bottom: and a peripheral wall connected to said bottom of said first container and having an upper end having a top edge; said peripheral wall of said first container including:

a proximal portion having:

a concave inner face; and a convex outer face; and a non-proximal portion having:

a concave inner face; and a convex outer face;

a second container adapted for holding liquid; said second container including:

a bottom; and a peripheral wall connected to said bottom of said second container and having an upper end having a top edge; said peripheral wall of said second container including:

a proximal portion proximal said proximal portion of said first container; said proximal portion of said second container having:

a convex inner face; and a concave outer face directly facing said convex outer face of said proximal portion of said peripheral wall of said first container; and a non-proximal portion having:

an inner face; and an outer face;

said peripheral walls of said first and second containers being downwardly inwardly sloping such that a plurality of said dual bucket assemblies are adapted for stacking in a nested arrangement; said non-proximal portions of said peripheral walls forming a generally elliptical perimeter;

connecting means connecting said upper end of said peripheral wall of said first container and said upper end of said peripheral wall of said second container such that said dual bucket has a longitudinal axis through both said containers defining a front side to one side of the longitudinal axis and a back side to the opposite side of the longitudinal axis;

a single bail including:

a distal end; and proximal ends including:

a front proximal end connected to said front side of said dual bucket; and a back proximal end connected to said back side of said dual bucket; said bail of sufficient length that it extends past peripheral walls such that it can be stowed in the horizontal position when a plurality of dual bucket assemblies 10 are stacked in nested arrangement; and leveling means attached to said dual bucket for selectively securing a proximal end of said bail such that the position of said distal end of said bail is selectively maintained substantially above the center of gravity of said dual bucket assembly when said assembly is freely hung from said distal end of said bail.

24. The dual bucket assembly of claim 23 wherein:

said containers have substantially the same depth.

25. A dual bucket assembly comprising:

a dual bucket comprising:

a first container adapted for holding wet masonry; said first container including:

a bottom: and a peripheral wall connected to said bottom of said first container and having an upper end having a top edge; said peripheral wall of said first container including:

proximal portion having:

a concave inner face; and a convex outer face; and a non-proximal portion having:

a concave inner face; and a convex outer face; said first container constructed of flexible material sufficiently deformable to shed therefrom wet masonry that has dried therein;

a second container adapted for holding liquid; said second container including:

a bottom; and a peripheral wall connected to said bottom of said second container and having an upper end having a top edge; said peripheral wall of said second container including:

a proximal portion proximal said proximal portion of said first container; said proximal portion of said second container having:

a convex inner face; and a concave outer face directly facing said convex outer face of said proximal portion of said peripheral wall of said first container; and a non-proximal portion having:

an inner face; and an outer face;

said peripheral walls of said first and second containers being downwardly inwardly sloping such that a plurality of said dual bucket assemblies are adapted for stacking in a nested arrangement; said non-proximal portions of said peripheral walls forming a generally elliptical perimeter; and connecting means connecting said upper end of said peripheral wall of said first container and said upper end of said peripheral wall of said second container.

26. The dual bucket assembly of claim 25 wherein:

said containers have substantially the same depth.

* * * * *